United States Patent [19]

Longsworth

[11] 4,277,951

[45] Jul. 14, 1981

[54] CRYOPUMPING APPARATUS

[75] Inventor: Ralph C. Longsworth, Allentown, Pa.

[73] Assignee: Air Products and Chemicals, Inc., Allentown, Pa.

[21] Appl. No.: 139,032

[22] Filed: Apr. 10, 1980

[51] Int. Cl.[3] ..... B01D 8/00

[52] U.S. Cl. ..... 62/55.5; 55/269; 62/268; 417/901

[58] Field of Search ..... 62/55.5, 100, 268; 417/901; 55/269

[56] References Cited

U.S. PATENT DOCUMENTS

| | | | |
|---|---|---|---|
| 3,338,063 | 8/1967 | Hogan et al. | 62/55.5 |
| 3,485,054 | 12/1969 | Hogan | 62/55.5 |
| 3,620,029 | 11/1971 | Longsworth | 62/55.5 |
| 4,121,430 | 10/1978 | Bächler | 62/55.5 |
| 4,150,549 | 4/1979 | Longsworth | 62/55.5 |

*Primary Examiner*—Ronald C. Capossela

*Attorney, Agent, or Firm*—James C. Simmons; E. Eugene Innis

[57] ABSTRACT

A cryopump consisting of cryopanels attached to an elongated source of refrigeration in which heat is transferred from cryopumping surfaces to various stages of refrigeration by conduction including a chevron baffle or louver mounted parallel to the long axis of the refrigerator source and directly to the warmest stage of refrigeration.

10 Claims, 5 Drawing Figures

CRYOPUMPING APPARATUS

TECHNICAL FIELD

This invention relates to creation of ultra-high vacuums utilizing cryopumps by the capture of gas molecules on extremely cold surfaces from enclosed volumes which have already been reduced to a very low pressure by a mechanical pump. In particular, the invention relates to cryopumping apparatus wherein a plurality of surfaces are cooled by conduction due to mechanical contact to the source of refrigeration and the panels are closed by a chevron baffle or louver facing the evacuated chamber.

BACKGROUND OF THE PRIOR ART

The prior art of cryopumping (cryogenic pumping) is adequately set out in the specification of U.S. Pat. No. 4,150,549, the specification of which is incorporated herein by reference. In the '549 patent, it is pointed out that cryopumping devices have used three surfaces to remove different gases from the vacuum environment. These surfaces generally have been cooled to various temperatures below 120° K. (Kelvin). These surfaces have been used to remove water and carbon dioxide (by freezing in the temperature range of 40° to 120° K.); nitrogen, oxygen, argon, carbon monoxide, methane and halogenated hydrocarbons (by freezing at temperatures between 10° and 25° K.) and helium, hydrogen and neon (by cryosorption at temperatures of 10° to 25° K.). Cryosorption is adsorbing gases in a sorbent at cryogenic temperatures as shown in the apparatus of the '549 patent. In the '549 patent, a chevron baffle or louver may be used to close the open end of the first stage or warm cryopanel). It is used to trap those gases which would normally be pumped out at the higher temperature from passing to the lower temperature cryopumping surfaces. One problem with using a chevron baffle in this type of refrigerator is that the heat input into the chevron baffle must be conducted around the cold or low temperature panel to reach the higher temperature stage or first heat station of the refrigeration source thus increasing the temperature difference between the chevron and the refrigerator.

BRIEF SUMMARY OF THE INVENTION

The present invention relates to a cryopumping apparatus having a multiple stage refrigeration source with panels for cryopumping various gases from a vacuum atmosphere at various temperatures connected to the stages of the refrigerator to provide heat conduction from the panel to the respective refrigeration stage. In particular, the invention discloses an improved chevron baffle which is thermally connected more directly to the higher temperature stage of refrigeration resulting in a lighter warm cryopanel, faster cryopanel cooldown, more compact geometry and provision for vertical mounting of the refrigeration source.

DETAILED DESCRIPTION OF THE INVENTION

Figure 1:
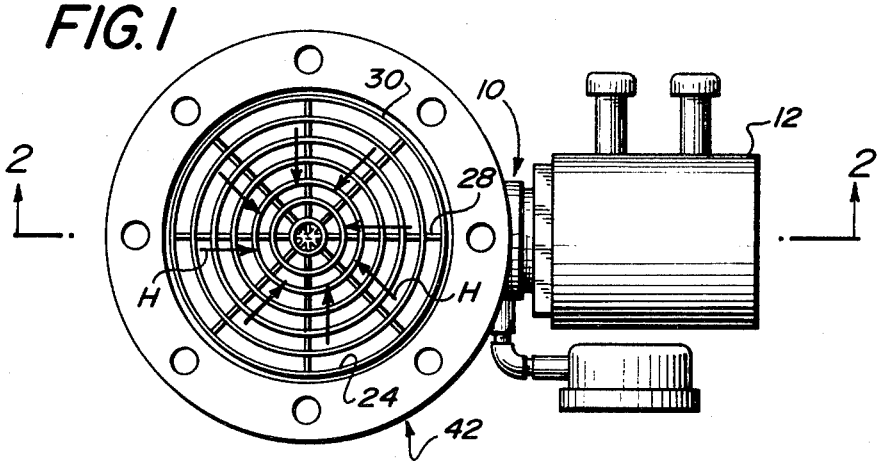
FIG. 1 is a front elevational view of a cryopump according to the present invention.

The apparatus of the present invention consists of a cryopump with cryopanels attached to a multiple stage refrigerator adapted to produce refrigeration in one stage of from 40° to 120° K. and in a second stage of from 10° to 30° K. Cryopanels are directly connected to the respective stages of refrigeration to transfer heat from the cryopumping surfaces of the panels to the refrigerator by conduction. In addition, the cryopumping apparatus, as presented to the vacuum chamber, is closed by a chevron baffle or louver which is adapted to receive most of the heat that flows into the first stage of the refrigerator.

As noted above, U.S. Pat. No. 4,150,549 shows a typical cryopump in which the cold panel is surrounded by the warm panel which may be closed on the front end by a chevron baffle or louver. The term chevron is sometimes used to denote a chevron baffle. In vacuum systems where water vapor constitutes a significant part of the gas load on a cryopump, the surface that it freezes out on will become black to thermal radiation and thus absorb the heat that is radiated from the vacuum chamber. For example, 10 grams per square meter of water will absorb about 80% of the 420 watts per square meter of heat radiated from a vacuum chamber at room temperature if it has a black interior. The heat input is distributed over a chevron baffle and then must be transferred by conduction to the support webs of the chevron and through the warm panel to the first stage heat station of the refrigerator. The thickness and weight of these parts is set primarily by the need to maintain a reasonably small temperature difference between the warmest part of the chevron baffle and the refrigerator, typically less than 30° K.

As cryopumps increase in size, the heat load which is proportional to the area increases as the diameter to the second power. Because of the need to transport the heat a longer distance, the weight of the warm cryopanel and chevron baffle are observed to increase by the diameter to the fourth power. This is adequately illustrated by comparing a model HV-202-8C and a model HV-208-20C cryopump manufactured and sold by Air Products and Chemicals, Inc. of Allentown, Pa. The comparison is set forth in Table 1.

TABLE 1

| MODEL | HV-202-8C | HV-208-20C |
|---|---|---|
| Pump ID-in (mm) | 7.87 (200) | 21.75 (553) |
| First Stage Heat Load, Design - W | 10 | 80 |
| Weight of Louver lbs (Kg) | .57 (.26) | 11 (5.0) |
| Weight of Panel lbs (Kg) | .93 (.42) | 35 (15.9) |
| | 1.50 (.68) | 46 (20.9) |
| Cooldown Time - hours | 1.5 | 5.5 |

The fact that the weight of the warm panel and chevron baffle increase at a much greater rate than the size of the refrigerator results in the cooldown time being appreciably longer. These heavier panels further put a bending load on the refrigerator cylinder if it is mounted horizontally so that additional supports must be added. These additional supports are sources of heat loss in the cryopumping apparatus.

The present invention has for its primary purpose the reduction of the weight of the warm cryopanel assembly. Reducing the weight of the warm cryopanel assembly which includes a first or warm panel and the chevron baffle or louver results in a faster cooldown, more flexibility in mounting orientation of the refrigerator without the need for auxiliary supports, and a reduction in materials of fabrication. The foregoing features are accomplished by orienting the chevron baffle or louver parallel to the long axis of the refrigerator so that it may be brought into more direct contact with the first heat station of the refrigerator as will be hereinafter be more fully explained.

Figure 2:
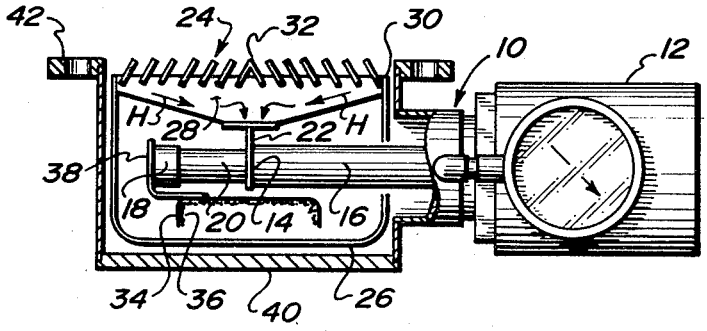
FIG. 2 is a section taken along the line 2—2 of FIG. 1.

Referring to FIGS. 1 and 2, there is shown a cryopumping apparatus designated generally as 10 which includes a source of cryogenic refrigeration 12, a preferred refrigerator being a model CS-202 offered for sale by Air Products and Chemicals, Inc. of Allentown, Pa. under the trademark DISPLEX. This refrigerator is also disclosed in U.S. Pat. No. 3,620,029, which patent specification is incorporated herein by reference. This type of refrigerator operates on a modified Solvay Cycle Producing refrigeration in the order of 77° K. at the bottom 14 of first stage 16 and refrigeration of 15° K. at the bottom 18 of second stage 20. First stage 16 has an adaptor bracket 22 which supports chevron baffle or louver 24. Chevron baffle or louver 24 closes a first stage or warm panel 26 which surrounds a substantial portion of the first and second stages 16, 20 of refrigerator 12. The louver contains a supporting web 28 which increases in thickness from the outer edge 30 to the center 32 in order to achieve an acceptable temperature difference with a minimum amount of material. As stated before, the louver 24 closes a lightweight warm panel 26. Cold panel 34 containing a cryosorbent 36 on its interior surface is disposed opposite the chevron or baffle 24 and thermally connected to the second stage 20 of refrigerator 12 by a support 38. As shown in FIGS. 1 and 2 by the arrows H, the heat is conducted along the web of the chevron to the center through mounting bracket 22 to the first stage 16 of refrigerator 12. The refrigerator and cryopanels are closed by a housing 40 containing a suitable mounting flange 42 for mounting the cryopump to a vacuum chamber. Housing 40 and panels 26 and 34 can be in the general shape of open top pans the shape of the pan being complimentary to a corresponding opening on the vacuum chamber (not shown). The pans can be circular in shape, rectangular in shape, or any other convenient shape to achieve the object of the invention which is to orient the chevron baffle or louver parallel to the long axis of the refrigerator so that it can be brought into more direct contact with the first stage heat station of the refrigerator thus preventing heat from being conducted by the chevron around the cold panel 34 prior to reaching the first stage 16 of refrigerator 12.

Figure 3:
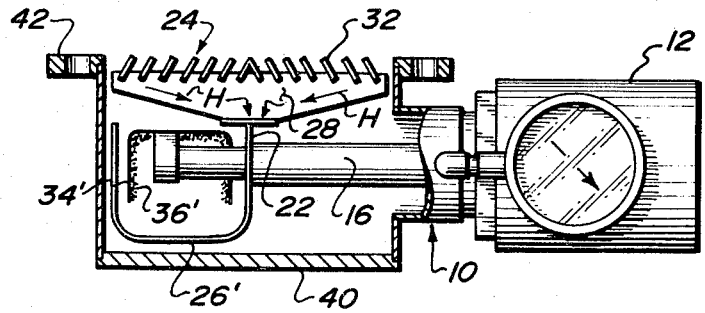
FIG. 3 is an alternate embodiment of the apparatus of FIG. 2.

There is shown in FIG. 3 an alternate embodiment of the apparatus of FIGS. 1 and 2 with an identical louver 24. The cold panel 34' is mounted off the axis of the refrigerator. The warm panel 26' is of smaller configuration with the two panels being sized depending upon the desired speed and capacity for pumping water vapor which freezes out on the chevron 24 as opposed to the pumping characteristics for the other gases that freeze out or are adsorbed on the cold panel 34'. These design criteria are well-known to a worker skilled in the art. As with the apparatus of FIG. 1, the heat load on chevron baffle 24 is conducted according to the arrows H to the first stage 16 of refrigerator 12 through the support 22. The housing 40 of the apparatus of FIG. 3 is identical or can be to the apparatus of FIGS. 1 and 2.

Figure 4:
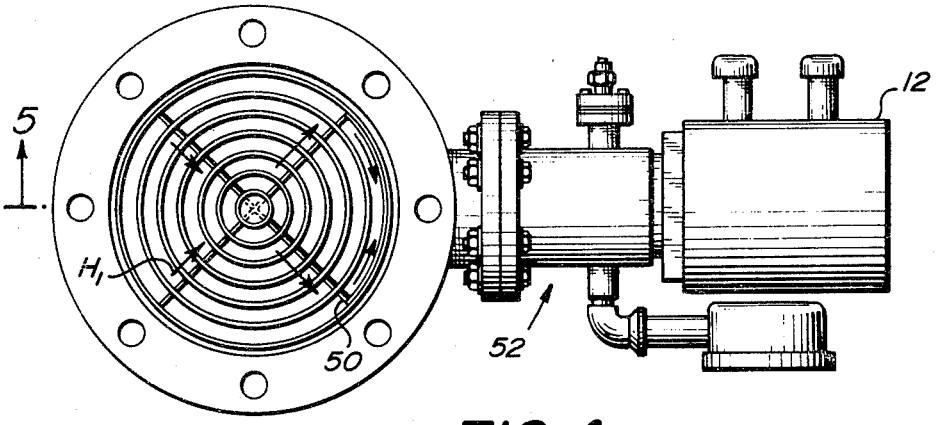
FIG. 4 is a front elevational view of an alternate embodiment according to the present invention.
Figure 5:
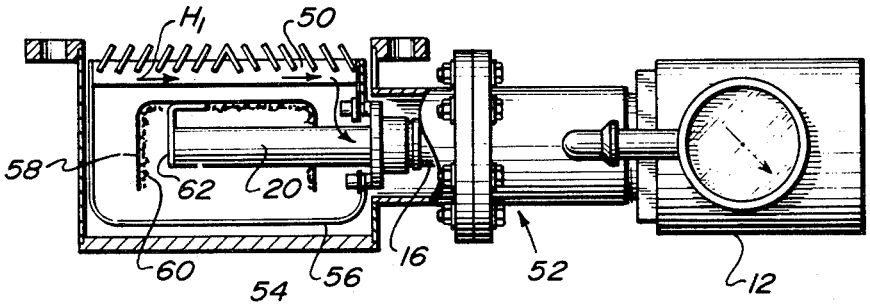
FIG. 5 is a view taken along the line 5—5 of FIG. 4.

Referring now to FIGS. 4 and 5, there is shown an arrangement in which the louver or baffle 50 is attached on its edge to the refrigerator 12. In the apparatus of FIGS. 4 and 5, housing 52 is adapted to extend substantially along the length of first stage 16 of refrigerator 12 terminating in a generally pan-shaped portion 54 which surrounds a portion of first stage 16 and all of second stage 20 of refrigerator 12. In the apparatus of FIGS. 4 and 5, chevron or louver 50 closes a warm panel 56 which is thermally connected to the first stage 16 of refrigerator 12. Cold panel 58 containing a cryosorbent 60 on its inner surface is connected through adaptor 62 to the second stage 20 of refrigerator 12 as is well-known in the art. As shown by the arrows H1 in FIGS. 4 and 5, heat is conducted along the web of the lower 50 to the first or warm stage of the refrigerator 12 as in the case of the apparatus of FIGS. 1–3.

Prior art cryopanel designs allow about a 15° K. temperature difference between the warmest part of the chevron or louver and the edge mounts, and another 15° K. temperature difference between the edge mounts and the refrigerator. According to the present invention, mounting the louver directly to the refrigerator permits the entire 30° K. temperature difference to be taken through the louver which permits its weight to be less than that of present louvers or chevron baffles. In the example given above, the weight of the louver and warm panel for the model HV-208-20C cryopump can be reduced from a present weight of 46 pounds (20.9 kg) to less than 15 pounds (6.8 kg) and thus reduce cooldown time from 5.5 hours to less than 2 hours.

Cryopumps according to the present invention offer a low profile in the sense that the distance from the inlet face of the cryopump to the back face is reduced to a minimum. For example, in the HV-202-8C cryopump, there is an axial length of 20.2 inches (513 millimeters). A cryopump according to the present invention has an axial length of 5.6 inches (143 millimeters).

While the invention has been illustrated with a two stage refrigerator a multiple stage refrigerator can be utilized. With a multiple stage refrigerator the warm panel and chevron or louver are coupled to the warmest stage of the refrigerator and the cold panel to the coldest stage of the refrigerator.

STATEMENT OF INDUSTRIAL APPLICATION

Cryopumps according to the present invention provide for a lighter warm cryopanel thus promoting faster cooldown, more compact geometry, and vertical mounting of the cryopanel on the refrigerator.

Having thus described my invention, what is desired to be secured by Letters Patent of the United States, is set forth in the appended claims.

I claim:

1. In a cryopumping apparatus of the type including an elongated source of refrigeration adapted for mounting to a vacuum chamber and capable of producing a warm refrigeration stage of from 40 to 120K and a cold refrigeration stage of from 10 to 30K, the improvement comprising:

a generally open top pan-shaped housing adopted for mounting said refrigeration source to said vacuum chamber whereby said open top of said pan can mate to and close a complementing opening in said vacuum chamber;

a first or warm panel thermally connected to said warm refrigeration stage and adapted to shield said refrigeration source from ambient radiant heat;

a second or cold panel thermally connected to said cold stage of refrigeration; and a chevron baffle or louver closing a substantial portion of the open top of said housing and in thermal contact with said warm refrigeration stage.

2. An apparatus according to claim 1 wherein said louver is disposed parallel to the long axis of said refrigerator.

3. An apparatus according to claim 1 wherein a substantial portion of said warm stage and all of said cold stage of said refrigeration source extends across the open top portion of said housing.

4. An apparatus according to claim 1 or 2 wherein said warm panel is in the shape of an open top pan complementary to but smaller than said housing.

5. An apparatus according to claim 1 or 2 wherein said cold panel is in the shape of an open top pan mounted with said open top facing the bottom of said pan shaped housing.

6. An apparatus according to claim 1 wherein said refrigerator source is mounted so that only said cold stage extends across the open top portion of said housing.

7. An apparatus according to claim 1 wherein said refrigeration source is a closed cycle two-stage cryogenic refrigerator.

8. An apparatus according to claim 1 wherein said first and second panels are mechanically connected to the warm and cold stages of the refrigeration source respectively by means of solid conductors capable of rapid thermal transfer of refrigeration or heat.

9. An apparatus according to claim 1 wherein said housing, said warm panel and said cold panel are circular in cross-section.

10. An apparatus according to claim 1 wherein a gas adsorbing material is disposed on the inner surface of said second or cold panel.

* * * * *